US007171970B2

(12) United States Patent
Saida et al.

(10) Patent No.: US 7,171,970 B2
(45) Date of Patent: Feb. 6, 2007

(54) HAIR SETTING DEVICE

(75) Inventors: Itaru Saida, Osaka (JP); Hisashi Kitamura, Osaka (JP)

(73) Assignee: Matsushita Electric Works Ltd., Kadoma (JP)

( * ) Notice: Subject to any disclaimer, the term of this patent is extended or adjusted under 35 U.S.C. 154(b) by 137 days.

(21) Appl. No.: 10/500,471

(22) PCT Filed: Jan. 16, 2003

(86) PCT No.: PCT/JP03/00304

§ 371 (c)(1),
(2), (4) Date: Jul. 15, 2004

(87) PCT Pub. No.: WO03/061431

PCT Pub. Date: Jul. 31, 2003

(65) Prior Publication Data

US 2005/0016559 A1 Jan. 27, 2005

(30) Foreign Application Priority Data

Jan. 18, 2002 (JP) ..... 2002-010830

(51) Int. Cl.
*A45D 20/08* (2006.01)

(52) U.S. Cl. ..... 132/271 A

(58) Field of Classification Search ..... 132/269, 132/229, 118, 227, 271; 34/90
See application file for complete search history.

(56) References Cited

U.S. PATENT DOCUMENTS 4,936,027 A * 6/1990 Tsuji ..... 34/90
5,357,988 A * 10/1994 Nakamura ..... 132/232
6,119,702 A * 9/2000 Habibi ..... 132/224

FOREIGN PATENT DOCUMENTS

| | | |
|---|---|---|
| JP | 60-227708 | 11/1985 |
| JP | 63-309275 | 12/1988 |
| JP | 4-54240 | 5/1992 |
| JP | 6-21506 | 3/1994 |
| JP | 8-154727 | 6/1996 |
| JP | 9-000350 | 1/1997 |
| JP | 2001-332372 | 11/2001 |

OTHER PUBLICATIONS

English Language Translation of JP 60-227708.
English Language Abstract of JP 9-000350.
English Language Abstract of JP 63-309275.
English Language Abstract of JP 8-154727.
English Language Abstract of JP 4-54240.
English Language Abstract of JP 2001-332372.
English Language Abstract of JP 6-21506.

* cited by examiner

*Primary Examiner*—John J. Wilson
*Assistant Examiner*—Robyn Doan
(74) *Attorney, Agent, or Firm*—Greenblum & Bernstein, P.L.C.

(57) ABSTRACT

A hair setting instrument is provided which can set hair easily by supplying charges through a separate path. In concrete, the hair setting instrument comprises a mechanism for setting hair of a user, and an electrostatic charger which supplies charges to a body of the user for electrostatic charges generated by a movement for setting the hair. The electrostatic charger has a charging circuit which generates a predetermined voltage, and a charging plate electrically connected to the charging circuit. Wide spreading of the hair, electrostatic cling to the face or the like, dry hair, and the damage to the hair due to charging can be prevented. Further, for example, the body of hair can be decreased by supplying negative charges when the hair is charged with positive electrostatic charges.

6 Claims, 16 Drawing Sheets

HAIR SETTING DEVICE

TECHNICAL FIELD

The present invention relates to a hair setting instrument such as a hair brush or a hair iron for setting hair.

PRIOR ART

FIGS. 22A and 22B show a prior art general hair brush 40. FIG. 22A is a side sectional view of the hair brush 40, and FIG. 22B is a front view thereof. The prior art hair brush 40 has many bristles 10 formed on a bristle base 11 with a grip part 8. A user sets his or her hair by using only the hair brush or by using the hair brush in conjunction with a hair drier or the like.

However, when hair is brushed, positive charges are generated in the hair. Then the hair is spread widely, it clings to the face or the like, and it is felt dry. Further, cuticles of the hair are widened due to the charging, and this damages the hair.

In order to prevent the charging, the hair brush 40 is made of an electrically conducting plastics material. Thus, the electrostatic charges are led to the ground, or the generation of electrostatic charges due to friction is prevented. However, this only takes care of adhesion of dust and dirt to hair due to the friction on brushing, and it cannot solve the above-mentioned problems caused by the charges generated on brushing or the like.

DISCLOSURE OF INVENTION

An object of the invention is to provide a hair setting instrument which can set hair easily by supplying charges through a separate path, for the electrostatic charges due to brushing or the like. By using the hair setting instrument according to the invention, wide spreading of the hair, electrostatic cling to the face or the like, dry hair, and the damage to the hair can be prevented.

In concrete, a hair setting instrument according to the invention comprises a mechanism for setting hair of a user; and an electrostatic charger which supplies charges to a body of the user for electrostatic charges generated by a movement for setting the hair. The hair can be set easily with the charges given to the human body without affected by the electrostatic charges generated on brushing or the like.

Preferably, the electrostatic charger has a charging circuit which generates a predetermined voltage, and a charging plate electrically connected to the charging circuit. When the charging plate is contacted by a user, the charging plate supplies charges to the user's body according to the predetermined voltage outputted by the charging circuit.

Preferably, the predetermined voltage is one of a positive voltage for supplying positive charges to the user and a negative voltage for supplying negative charges to the user. By attracting hair to the scalp, even when the hair is brushed, it is not spread and is shaped appropriately, so that the body of hair can be decreased easily. On the other hand, positive charges can be given to the human body. In this case, because the hair is repelled from the scalp, it becomes easier to increase the body of hair.

Preferably, the charging circuit has a ground line through which a ground voltage is outputted. Then, the electrostatic charges generated on brushing can be removed easily.

Preferably, the electrostatic charger has a switch which outputs one of the positive voltage, the ground voltage and the negative voltage from the charging circuit. By changing the voltage with the switch on brushing, it can be freely selected to increase the body of hair, to decrease the body of hair and to remove the electrostatic charges of hair.

Preferably, the hair setting instrument further comprises a grip which a user can hold, and the charging plate is provided on a surface of the grip. Only by holding the grip by hand, the electric potential can be given to the human body.

Preferably, the charging plate is made of an electrically conducting material. Thus, the charging plate to which a human body contacts with will not become a charger, and there is no danger of electric shock.

Preferably, the hair setting instrument further has an electrically conducting sheet on a surface of the charging plate to which a user makes contact with the charging plate. The contact area between the charging plate and the human body is enhanced through the electrically conducting sheet, and charges can be given efficiently to the human body.

Preferably, the mechanism for setting user's hair has a brush and a mechanism which dries the hair. Thus, not only hair is brushed, but the hair is also dried at the same time.

Preferably, the mechanism for setting user's hair has a pair of heating plates for gripping the hair and a heater which heats the heating plates. Thus, not only the hair brushing, but the hair setting can also be performed by the heating plates.

BEST MODE FOR CARRYING OUT THE INVENTION

Figure 1A:
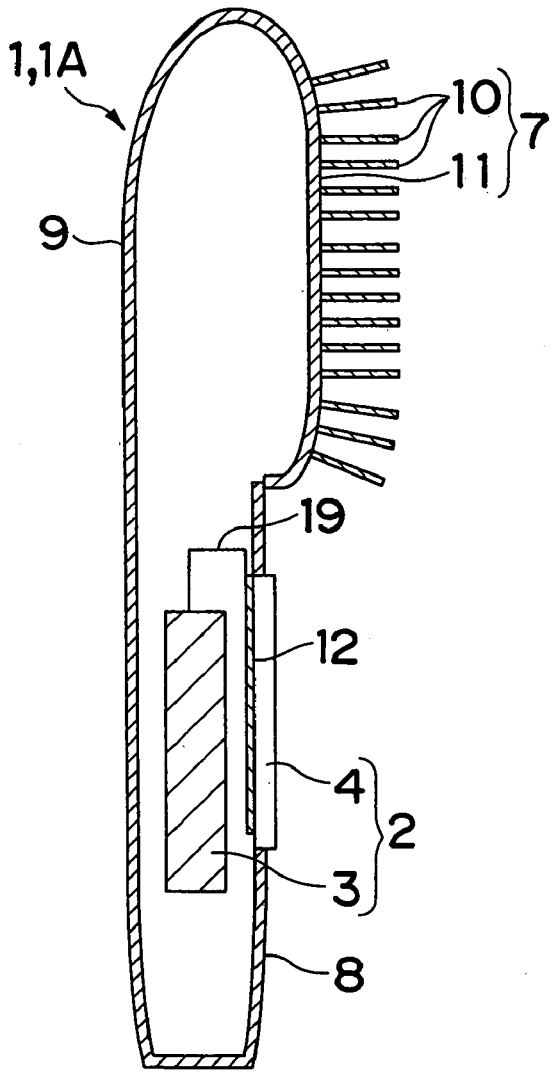
FIG. 1A is a side sectional view of a hair brush according to the invention.

Embodiments of the invention will be explained below with reference to the appended drawings. In the description, the operation principle of a hair set instrument 1 according to the invention is explained first, and embodiments thereof are explained next. In the drawings, like reference characters designate like or corresponding parts.

A principal feature of a hair setting instrument according to the invention is to provide charges of the same or the opposite polarity to a human body from the external thereof for the electrostatic charges generated while the hair is set. When charges of the polarity opposite to the generated electrostatic charges are supplied, they are canceled each other, so that the hair is not spread and it can be settled well into shape. On the other hand, when charges of the same polarity as the generated electrostatic charges are supplied, they repel each other, so that the body of the hair can be increased. When the hair setting instrument of the invention is used, the hair can be set easily with the electrostatic force caused by charges supplied to the user's body, without affected by the electrostatic charges generated on the hair setting with the hair setting instrument. Then, the problems of widening of the hair, static cling to the face or the like, and dry, loose hair and the damage to the hair can be solved at the same time.

It is to be noted that "hair setting" is referred to an operation for putting hair in order by exerting an external action such as brushing, drying with warm air or crimping of hair by gripping hair between a pair of heated plates. Then, a "hair setting mechanism" referred to in the specification means a mechanism for setting the hair.

Examples of the hair setting instrument 1 are explained below.

Figure 1B:
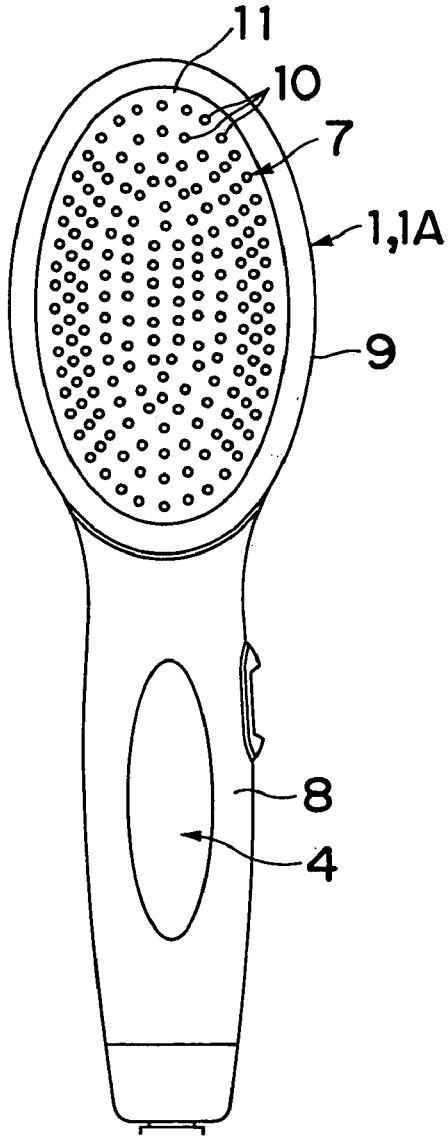
FIG. 1B is a front view of the hair brush.

FIGS. 1A and 1B are a side sectional view and a front view of a hair brush 1A according to the invention. The hair brush 1A has a main body 9 including a brush part 7 and a grip part 8 and an electrostatic charger section 2 for supplying positive or negative charges to the user's body. The brush part 7 is used as a mechanism for setting hair, and it has a bristle base 11 and many bristles 10 implanted on the base 11. The bristles 10 are made of a material, such as a molding material, lower than hair in triboelectric series or a material series such as glass higher than hair in triboelectric. The grip part 8 is a part held by a user when the user uses the hair brush 1A. The grip part 8 is made of an electrically insulating material such as a molding material. Because the grip part 8 is provided besides the brush part 7, a user can hold the hair brush 1A easily to set the hair easily. The grip part 8 may be formed to match with the shapes of fingers.

The electrostatic charger section 2 provides charges to a human body to increase or decrease the body of hair. The electrostatic charger section 2 has a charging circuit 3 embedded in the grip part 8 and a charging plate 4 connected to the charging circuit 3. The charging plate 4 may contact with the human body, and it is set on a part of the surface of the grip part 8. When a user holds the grip part 8 by hand, the charges are given through the charging plate 4 to the user's body. The charging plate is made of an electrically conducting material such as a metallic plate or a molding material or the like including an anti-charge material.

Figure 2:
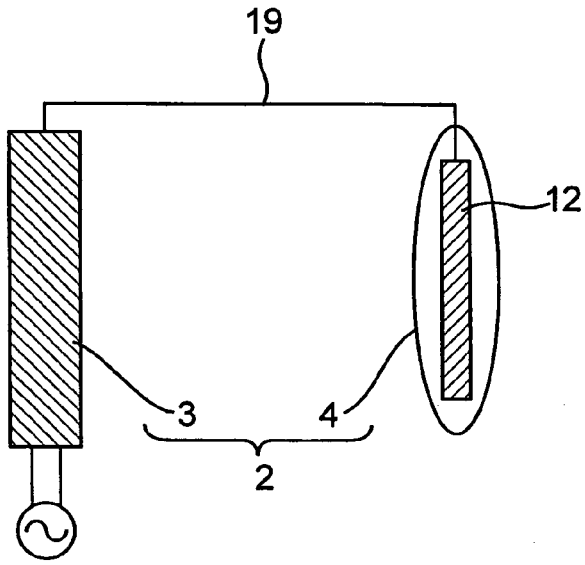
FIG. 2 is a diagram on connection between an electrostatic charging circuit and a charging plate.

FIG. 2 shows an example of the connection between the charging circuit 3 and the charging plate 4 in the electrostatic charger section 2. The charging circuit 3 is connected through a wire 19 to the charging plate 4. The wire 19 and the charging plate 4 are fixed with an electrically conducting fixing material such as an aluminum tape 12.

Figure 3:
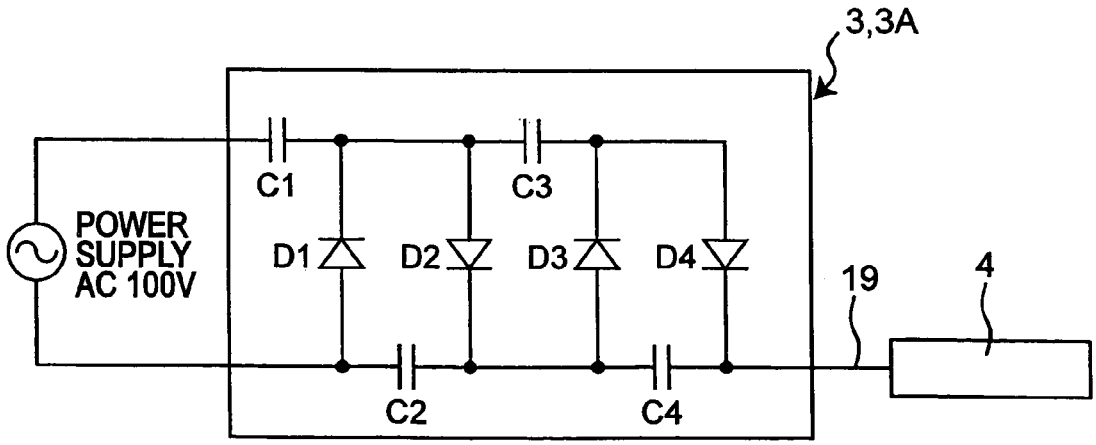
FIG. 3 is a diagram of a Cockcroft-Walton circuit as an example of the charging circuit which generates a positive voltage.
Figure 4:
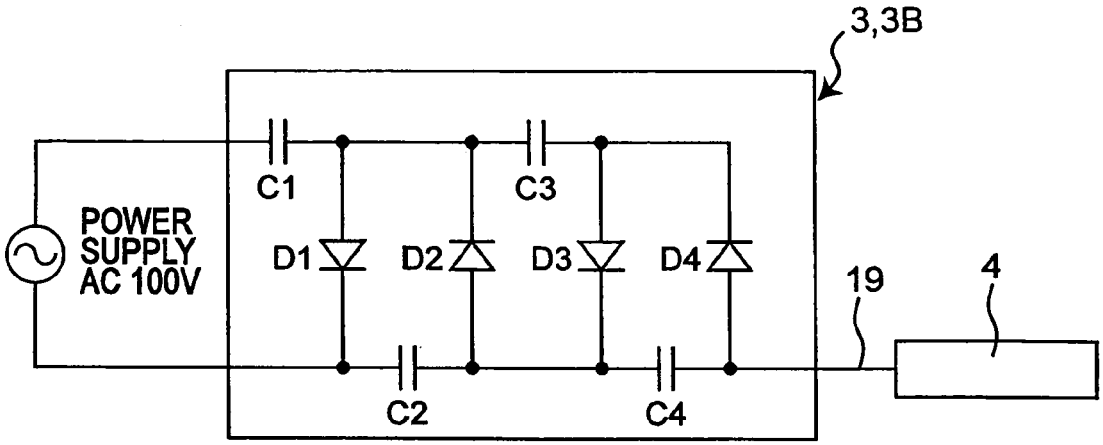
FIG. 4 is a diagram of a Cockcroft-Walton circuit as an example of the charging circuit which generates a negative voltage.

According to the invention, when the charger section 2 gives charges to a human body, one of the charging circuits 3 is selected according to the polarity of the charges (positive or negative charges). Each charging circuit 3 can supply charges to the human body 5 by applying a voltage to the human body 5. FIG. 3 shows a charging circuit 3 constructed as a Cockcroft-Walton circuit 3A which charges the human body negatively (which supplies negative charges). On the other hand, FIG. 4 shows a charging circuit 3 constructed as a Cockcroft-Walton circuit 3B which charges the human body positively (which supplies positive charges). In FIGS. 3 and 4, C1 to C4 denote capacitors for increasing a voltage, and D1 to D4 denote diodes as switching elements. A plurality of stages (four stages in this example) of a capacitor and a diode are combined, as shown in FIGS. 3 and 4, and a voltage of about +500 V (or about −500 V) is derived from the commercial power supply of AC 100 V.

Alternatively, two types of charging circuits may be provided to output a positive voltage and a negative voltage, and to use a switching mechanism to select one of the charging circuits. Alternatively, only one type of charging circuit 3A (FIG. 3) or 3B (FIG. 4) which outputs a positive or negative voltage may be included. In this case, the hair brush is used exclusively for making the body of hair high or low according to the combination with the material of the bristles 10.

Next, an operation (an example) of the hair brush 1A is explained. It is assumed here that the hair brush 1A has two types of charging circuits 3 (FIGS. 3 and 4) which output a positive voltage and a negative voltage, respectively, and that the charging plate 4 is made of an electrically conducting material.

When a user brushes hair with the hair brush 1A, the bristles 10 make contact with hair repetitively, and charges are generated due to the repetitive contact. If the bristles 10 are made of a material lower than hair in triboelectric series such as a molding material, the hair has positive charges and the bristles 10 have negative charges. On the other hand, if the bristles 10 are made of a material higher than hair in triboelectric series such as glass, the hair has negative charges and the bristles 10 have positive charges.

Figure 5:
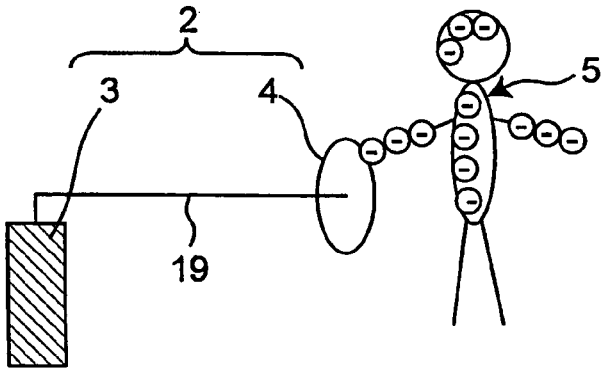
FIG. 5 is a diagram of a situation of a negatively charged human body.

Let us consider a case when positive electrostatic charges are generated in the hair. When a user is going to decrease the body of the hair, negative charges are added to the human body or to charge the human body negatively in order to cancel the positive charges. FIG. 5 shows a situation where a human body is negatively charged. In order to charge the human body 5 negatively, the charging circuit 3 in the electrostatic charger section 2 generates a negative output voltage, and the charging plate 4 connected through the wire 19 to the output terminal of the charging circuit 3 is charged negatively, and the entire charging plate 4 has a constant voltage. When a user takes the charging plate 4 by hand, as shown in FIG. 5, negative charges are moved through the hand to charge the scalp and the entire body negatively.

Figure 6:
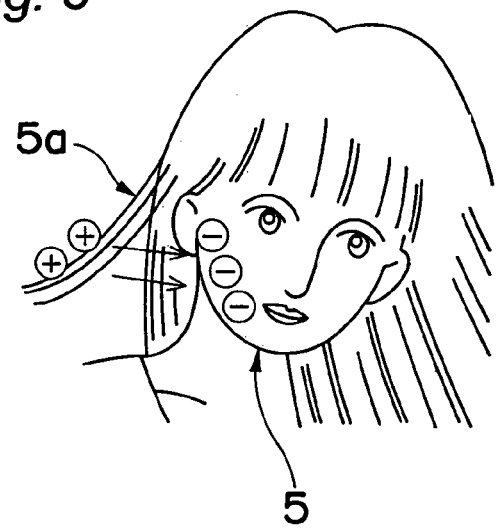
FIG. 6 is a diagram for decreasing the body of hair.

FIG. 6 shows schematically a situation when a human body 5 is charged negatively against the hair 5*a* charged positively. Because the hair 5*a* is charged positively on brushing, when the human body 5 is charged negatively, the hair 5*a* is attracted to the scalp due to the electrostatic force. Then, as shown in FIG. 6, the hair 5*a* will be shaped without being spread. Thus, it becomes easy to decrease the body of the hair 5*a*.

Figure 7:
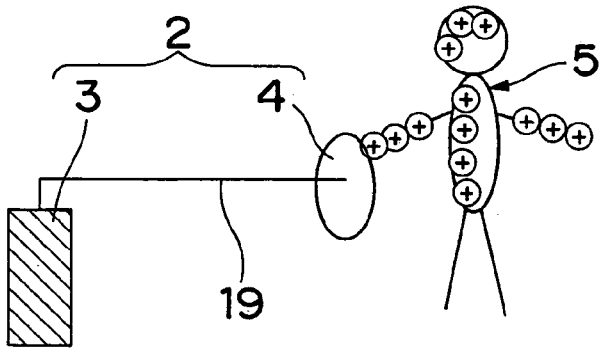
FIG. 7 is a diagram of a situation of a positively charged human body.
Figure 8:
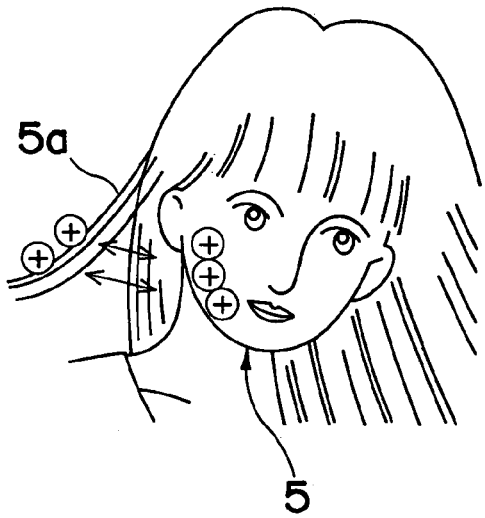
FIG. 8 is a diagram for increasing the body of hair.

On the other hand, when the body of hair 5*a* charged positively is increased, the human body 5 is charged positively to repel the hair 5*a* relative to the human body 5. FIG. 7 shows a situation where the human body 5 is positively charged. In order to positively charge the human body 5, the charging circuit 3 in the charger section 2 outputs a positive voltage, and the charging plate 4 connected through a wire 19 to the output terminal of the charging circuit 3 is charged positively. When the charging plate 4 is taken by hand, as shown in FIG. 7, positive charges are conducted through the hand to charge the scalp and the entire head positively. FIG. 8 shows schematically a situation when the human body 5 is charged positively against the positively charged hair 5*a*. Because the hair 5*a* and the scalp repel each other between the positive charges, the hair 5*a* will not cling to the face or the like, and it becomes possible to increase the body of the hair, as shown in FIG. 8.

When negative electrostatic charges are generated in the hair 5*a* on brushing or the like due to the material of the bristles 10, by supplying positive charges to charge the human body 5 positively, the body of hair 5*a* can be decreased, while by supplying negative charges to charge the human body 5 negatively, the body of hair 5*a* can be increased According to the above-mentioned principle, the volume of hair 5*a* can be increased or decreased easily due to the electrostatic force generated by the charged body 5, without affected by the electrostatic charges generated on brushing of hair 5*a*. Then the problems of the spread of the hair, static cling to the face or the like, dry hair and damage to the hair can be solved at the same time. In this embodiment, the electrostatic charger section 2 for providing charges to the human body 5 has a shape of a grip. Therefore, a user only holds the grip to charge the human body 5, and the above-mentioned advantages can be obtained easily.

Figure 9:
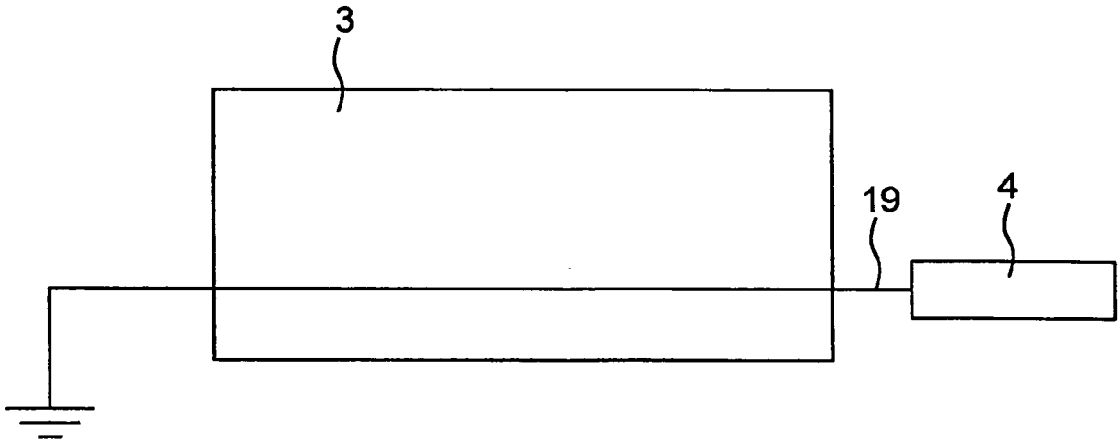
FIG. 9 is a diagram in a case when a charging circuit is connected directly to the earth.
Figure 10:
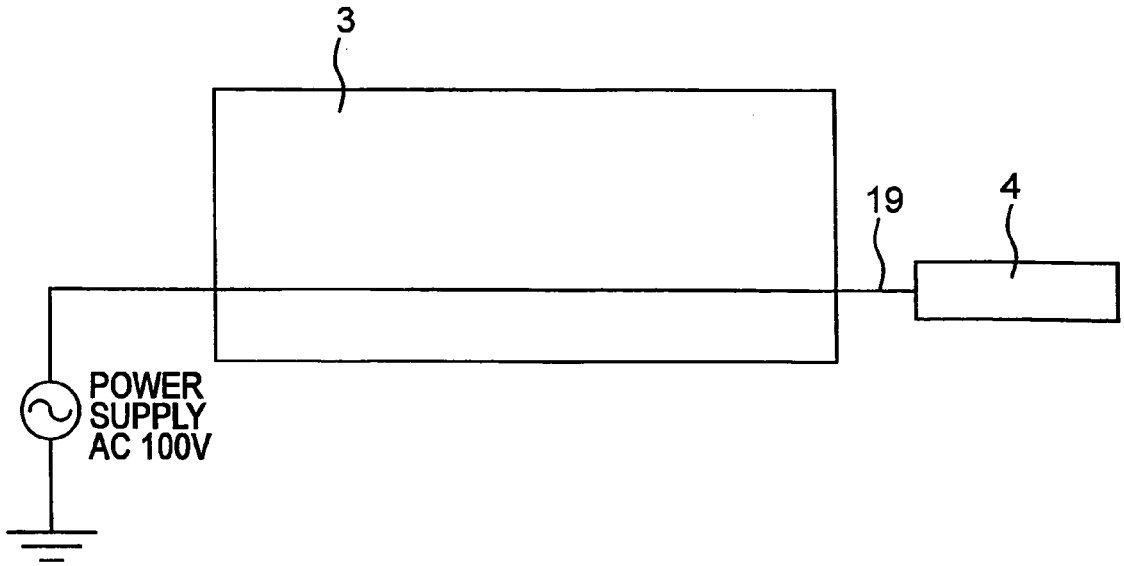
FIG. 10 is a diagram in a case when a charging circuit is connected to a terminal of a commercial power supply.

Next, another embodiment of the above-mentioned hair setting instrument 1 is explained with reference to FIGS. 9 to 11. FIG. 9 shows a case wherein the charging circuit 3 is connected directly to the ground. An earth line is provided to connect the charging circuit 3 to the ground, so that the charging circuit 3 outputs the ground voltage of zero voltage, and the voltage at the charging plate 4 becomes zero volt. Thus, the electrostatic charges in the hair 5*a* of a user who holds the charging plate 4 can be removed. On the other hand, FIG. 10 shows case wherein a charging circuit is connected to a terminal of the commercial electric power. When the charging plate 4 is made of a molding material including a material for preventing charging, the electric conductivity of the molding material is increased. Then, the entire molded product becomes zero volt. The output of the charging circuit 3 is connected to the charging plate 4, similarly to the above-mentioned embodiment.

Figure 11:
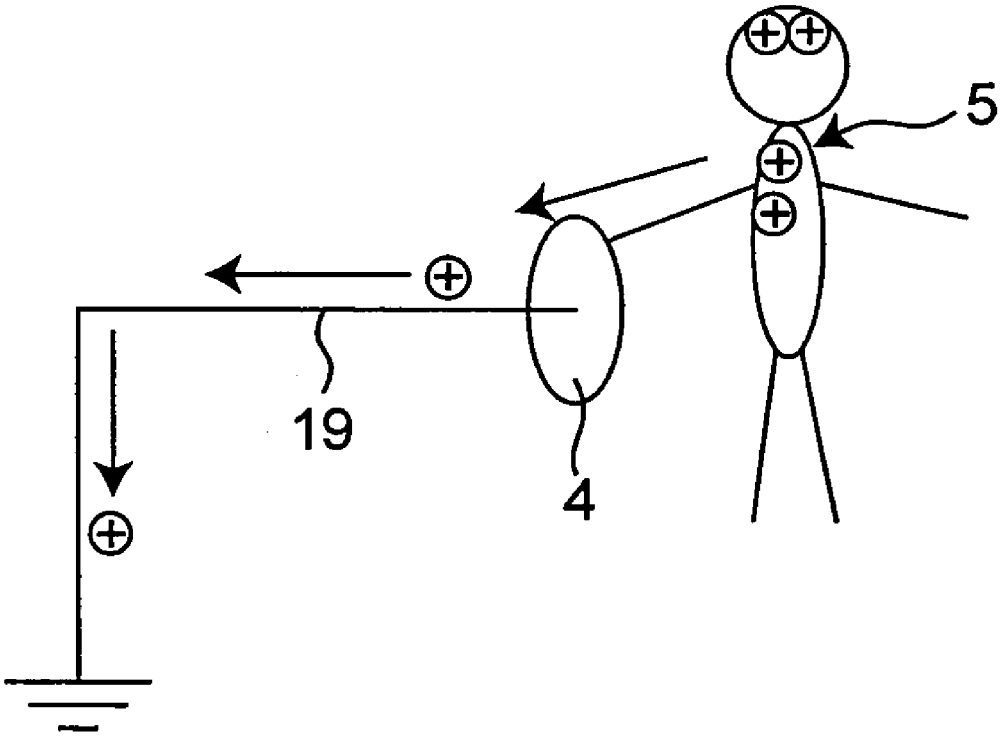
FIG. 11 is a diagram in a situation when negative charges generated on brushing in a human body are discharged.

FIG. 11 shows schematically that positive electrostatic charges are removed from a human body 5. As explained above, the output of the electrostatic charging circuit 3 is set to zero volt. Alternatively, the charging plate 4 is connected to the output of the electrostatic charger circuit 3 so as to have a low impedance for the ground. Then, the charging plate 4 becomes zero volt relative to the ground. Then the scalp and the entire body in contact with the charging plate 4 becomes zero volt. Then the electrostatic charges generated on brushing can be discharged through the human body 5. That is, by setting the output voltage of the electrostatic charger circuit 3 to zero, the electrostatic charges in the hair 5*a* can be removed easily, so that the hair 5*a* is not spread and is shaped appropriately, and that the hair 5*a* is not damaged.

Figure 12:
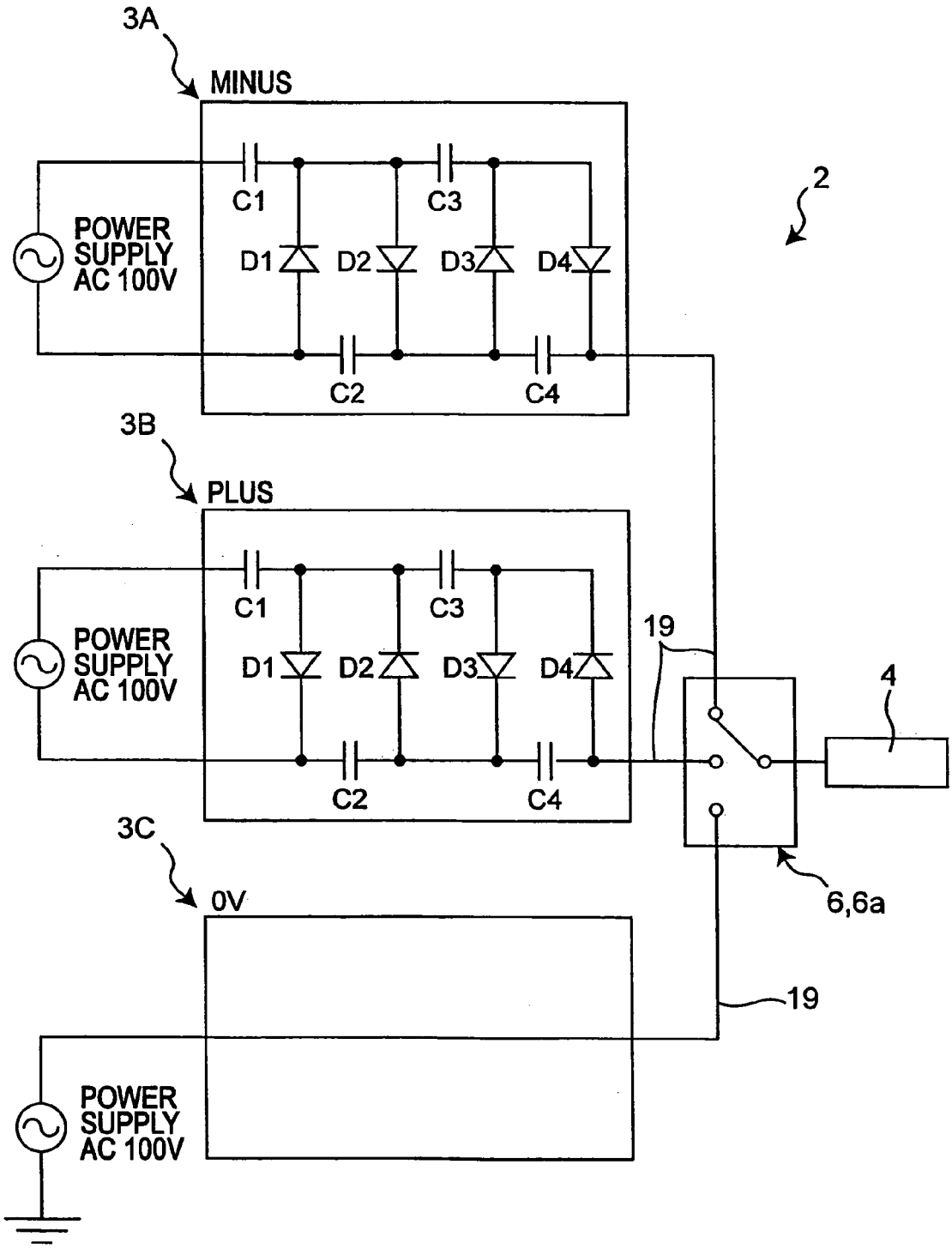
FIG. 12 is a circuit diagram including a switching mechanism for changing the charging circuits.

FIG. 12 is a circuit diagram of the electrostatic charger section 2 having a switching mechanism 6 for changing the output voltage to a positive voltage, a negative voltage or zero volt to be given to the human body 5. In this embodiment, the electrostatic charger section 2 has an electrostatic charging circuit 3A which outputs the negative voltage, another electrostatic charging circuit 3B which outputs a negative voltage, and a third electrostatic charging circuit 3C which outputs zero volt. These charging circuits are explained above with reference to FIGS. 3, 4 and 10. A switch 6*a* as the switching mechanism 6 is provided between the output terminals of the charging circuits 3A to 3C and the charging plate 4.

When hair 5*a* (FIG. 6) is brushed, the switch 6*a* can be used to select one of the positive voltage, the negative voltage and the zero volt. Therefore, a user can decrease or increase the body of hair 5*a* or remove the electrostatic charges in hair 5*a*.

Figure 13:
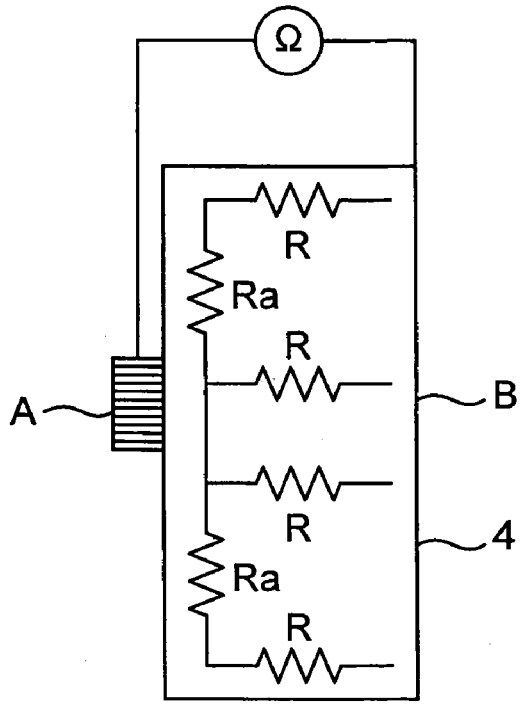
FIG. 13 is an equivalent circuit diagram of an internal resistance of the charging plate made of an electrically conducting molding material.

When the charging plate 4 is made of a material having an electrically conducting material such as a metallic plate and the charging circuit 3 has a structure as shown in FIGS. 3 and 4, the charging plate 4 is dealt as a chargeable portion because the primary side of the power supply is not insulated electrically from the charging plate 4. However, in this structure an electric shock may occur when the charging plate 4 is touched, and this is a problem on safety. Then, it is preferable that the charging plate 4 provided for contact with the human body 5 is made of a molding material as an electrically conducting material. FIG. 13 is an equivalent circuit diagram of internal resistance of the charging plate 4 made of an electrically conducting molding material. In FIG. 13, R denotes resistance in horizontal direction and Ra denotes resistance in vertical direction. Because the resistance of the molding material is distributed uniformly, the resistance between A and B is shown as R1 in Eq. (1) as follows:

$$1/R\ 1=1/\ (R+Ra)+1/\ (R+Ra)+1/R+1/R. \quad (1)$$

When the charging plate 4 is made of a molding material including an electrically conducting material, the resistance value R1 of the molding material is so large that the electric current does not flow when a man touches the charging plate 4. Then there is no danger of electric shock. Further, a material having volume resistivity equal to or larger that $1*10^{10}$ ohm/cm is dealt as an insulating material in the laws for electric safety, so that the charging plate 4 itself will not become a charger. That is, because the charging plate 4 is made of an electrically conducting molding material, the electrostatic charger section 2 does not contact with the chargeable portion, and there is no danger of electric shock.

Further, as a commercial product it satisfies the laws for the safety of electrical products and the like and for the product liability.

Figure 14:
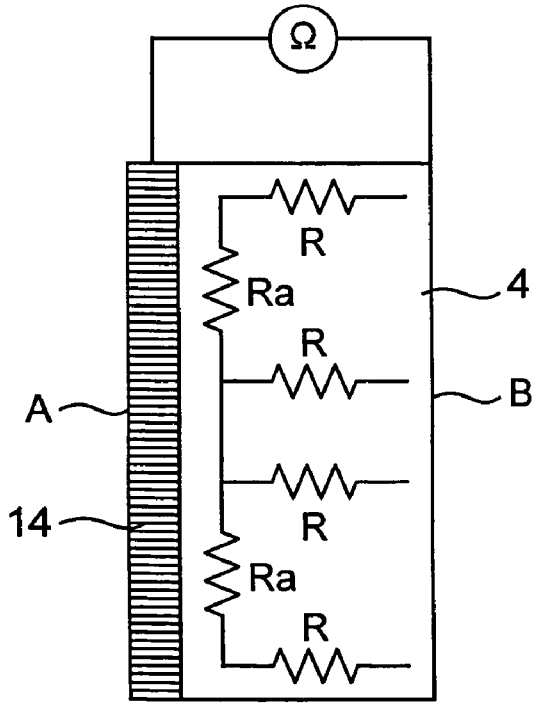
FIG. 14 is an equivalent circuit diagram of an internal resistance of the charging plate made of an electrically conducting molding material and connected to an electrically conducting sheet.

FIG. 14 is a circuit diagram for a modified example of FIG. 13. In this circuit, an electrically conducting sheet 14 made of an electrically conducting molding material is connected to a terminal of the charging plate 4 to be contact with a human body 5. In FIG. 14, the resistance between A and B is represented as R2 shown in Eq. (2) as follows:

$$(1/R\ 2)=(1/R)+(1/R)+(1/R)+(1/R). \quad (2)$$

Figure 15A:
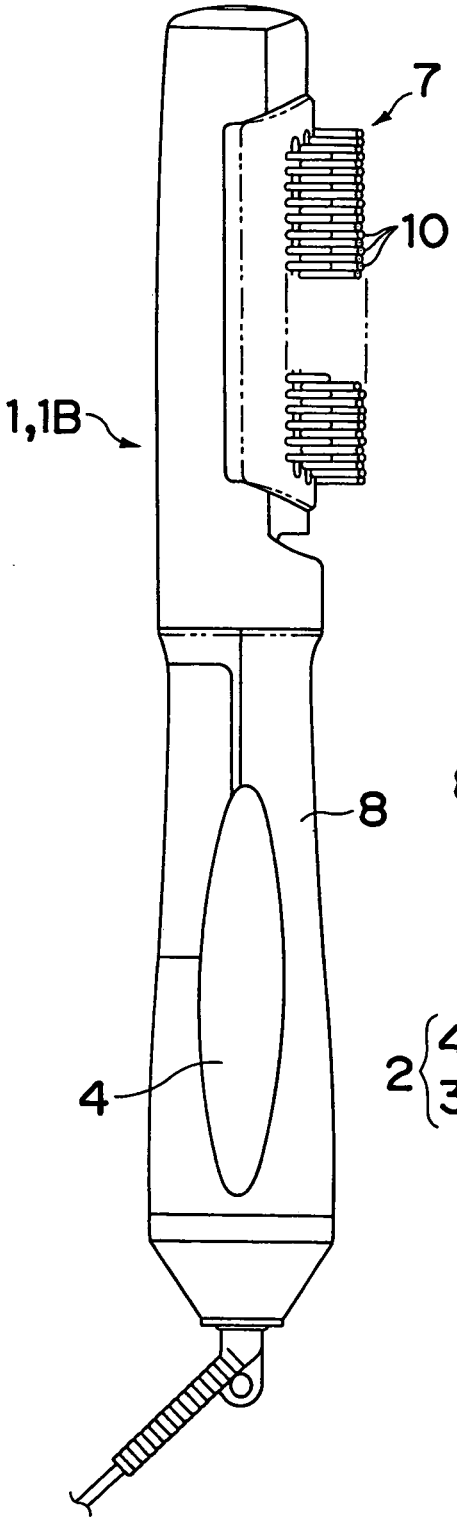
FIG. 15A is a side view of a hair brush having a drier mechanism.
Figure 15B:
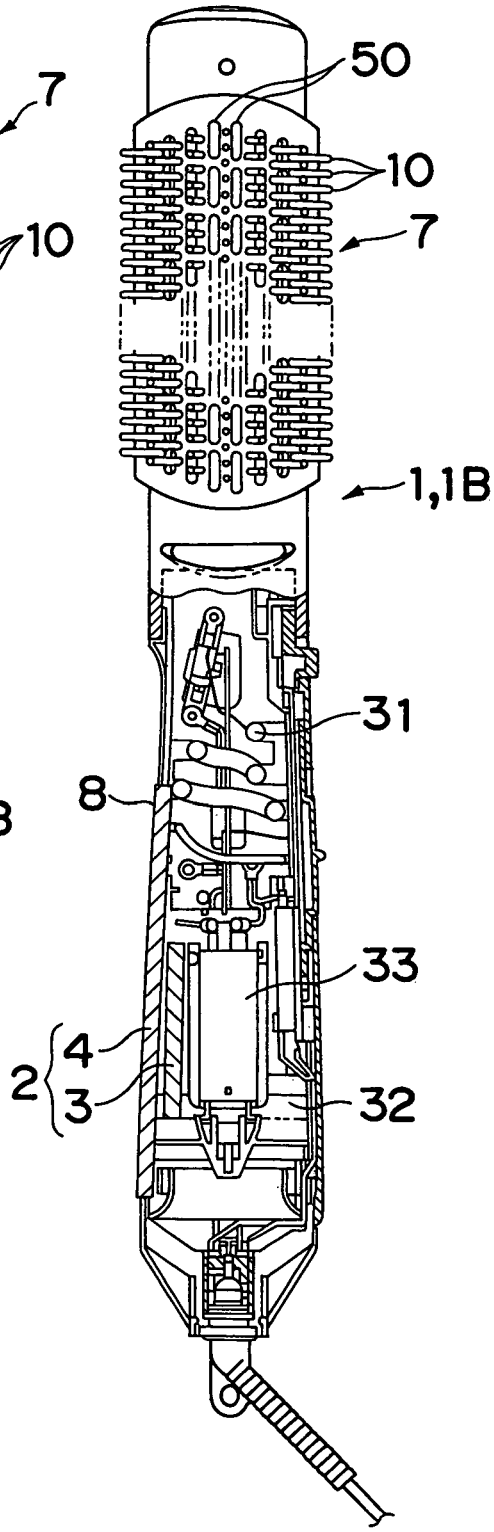
FIG. 15B is a partial broken view of the hair brush.

In the connection state shown in FIG. 14, the resistance value Ra in the vertical direction becomes smaller. Further, if the resistance value Ra becomes large, R1>R2. Then, as shown in FIG. 14, by providing an electrically conducting sheet made of an electrically conducting material, the internal resistance of the charging plate can be decreased. When the internal resistance of the charging plate 4 becomes small, a larger amount of electrons are moved, so that the advantage of the charging becomes high, and the human body 5 can be charged FIGS. 15A and 15B are a side view and a partial broken view of a hair brush 1B having a drying mechanism for hair. The structure of the hair brush 1B is similar to that of the hair brush 1A (FIGS. 1A and 1B) except the drying mechanism for hair. Then, only the drying mechanism is explained below. The mechanism for setting the hair in the hair brush 1B is the brush part 7 and the drying mechanism for hair to be explained later.

The drying mechanism for hair is embedded in the grip part 8 of the-hair brush 1B, and it consists of a heater 31, a fan 32 and a motor 33. When the fan 32 is driven by the motor 33, a wind is blown towards the brush part 7. Because the heater 31 provided in the middle of a path to the brush part 7 heats the wind, a warm wind is blown from outlets 50 provided between the bristles 10. Thus, not only the hair 5*a* is brushed for setting, but the hair 5*a* is also dried. When the hair is dried, it is thought that the electrostatic charges are liable to be generated more. However, by using the charging circuit 3 and the charging plate 4 to charge the human body 5 with electrostatic charges having the polarity opposite to that of the generated charges in the hair, hair can be set easily as mentioned above.

Figure 16A:
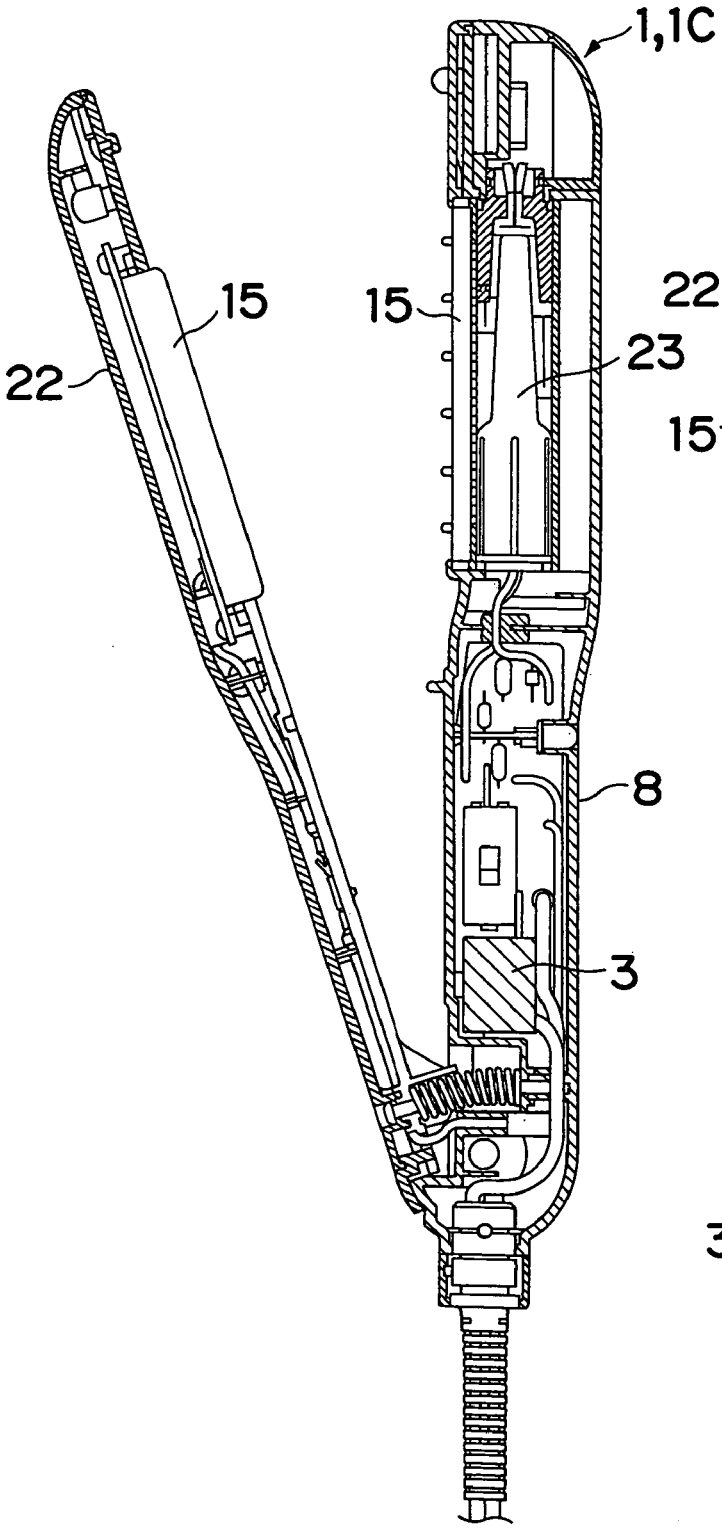
FIG. 16A is a side sectional view of a hair iron having an electrostatic charger in a state where a heat plate is opened.
Figure 16B:
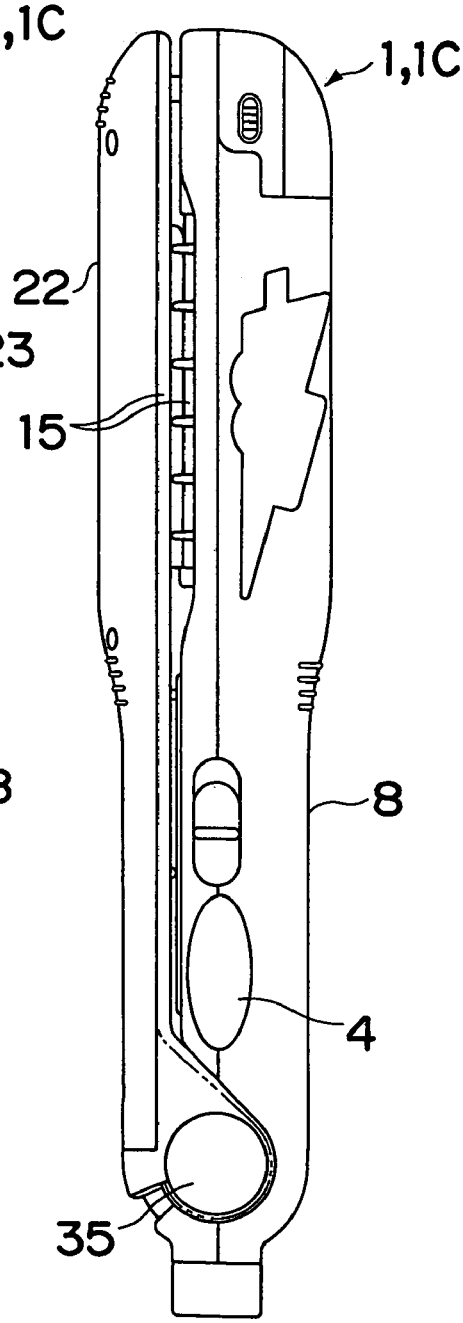
FIG. 16B is a side view of the hair iron where the heat plate is closed.

FIGS. 16A and 16B are a side sectional view and a side view of a hair iron 1C. As shown in FIG. 16A, the hair iron 1C has a pair of heating plates 15 and a heater 23 for heating the plates 15. As shown in FIG. 16B, a cover 22 including one of the heating plates 15 and a grip part 8 including the other thereof are set to be opened or closed around a rotation axis 35. This structure explained above is a mechanism for setting hair in the hair iron 1C. The hair iron 1C is similar to the hair brush 1A (FIGS. 1A and 1B) in that the electrostatic charger circuit 3 (FIG. 16A) for supply charges and the charging plate 4 are provided.

When hair is set by the hair setting mechanism, if the heating plate 15 and the molded components around the heating plate such as bristles 10 makes contact repetitively with hair 5*a*, the hair 5*a* is charged (FIG. 6). Then, similarly to the hair brush 1A (FIGS. 1A and 1B), the human body 5 is charged by the electrostatic charger section 2. Thus, an advantage similar to that explained above on the hair brush 1A can be realized. As to the hair iron 1C, when hair 5*a* is interposed between the pair of heating plates 15 and heated with the heater 23, hair 5*a* can easily be extended straightly. Further, when hair 5*a* is interposed between the pair of heating plates 15 and heated with the heater 23 while rotated, hair 5*a* can easily be curled.

Figure 17A:
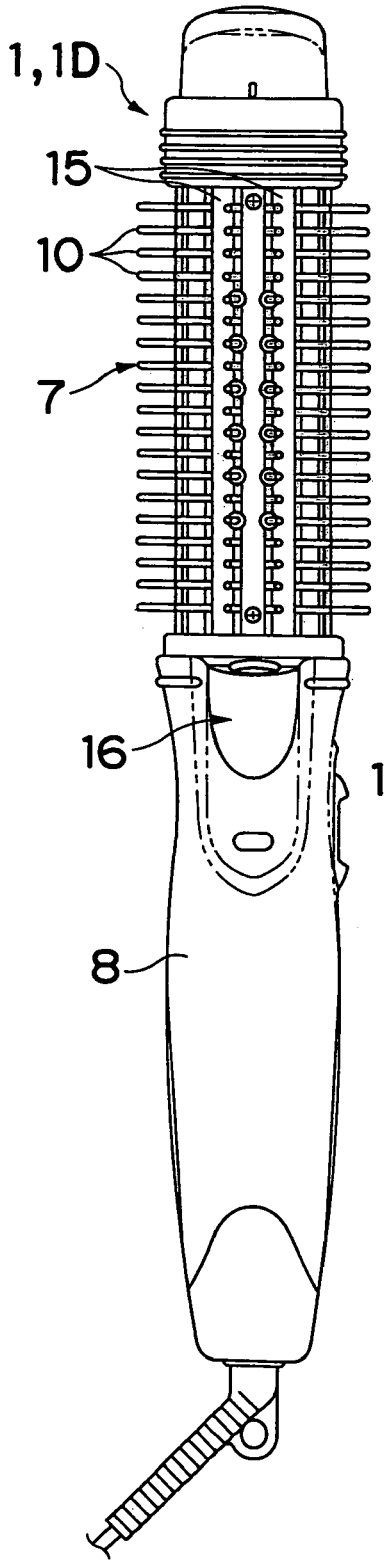
FIG. 17A is a side view of a hair iron of another example.
Figure 17B:
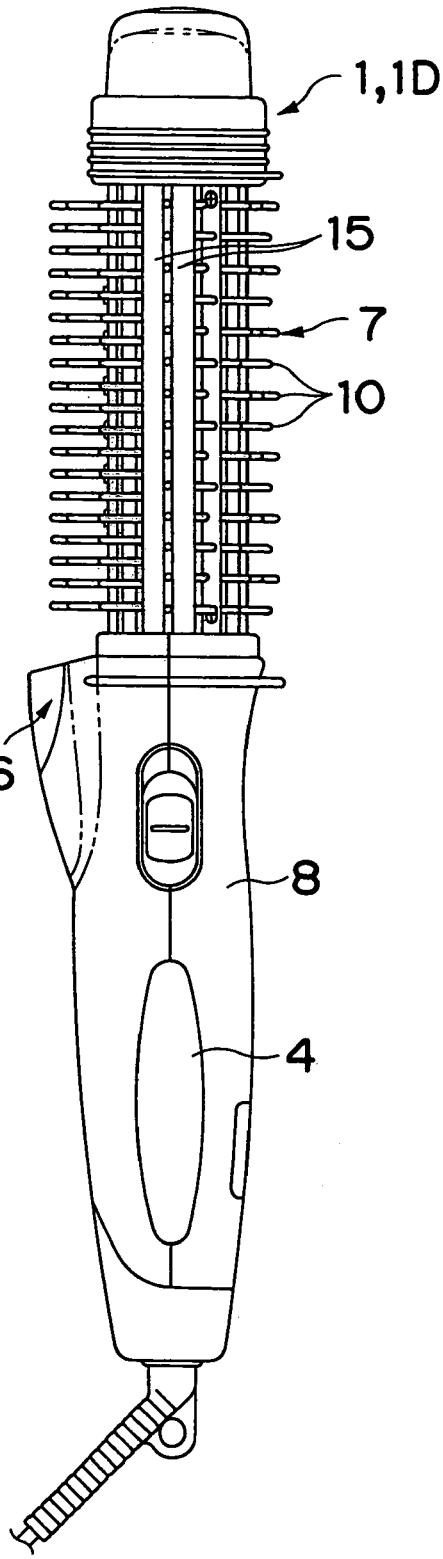
FIG. 17B is a front view of the hair iron.
Figure 18A:
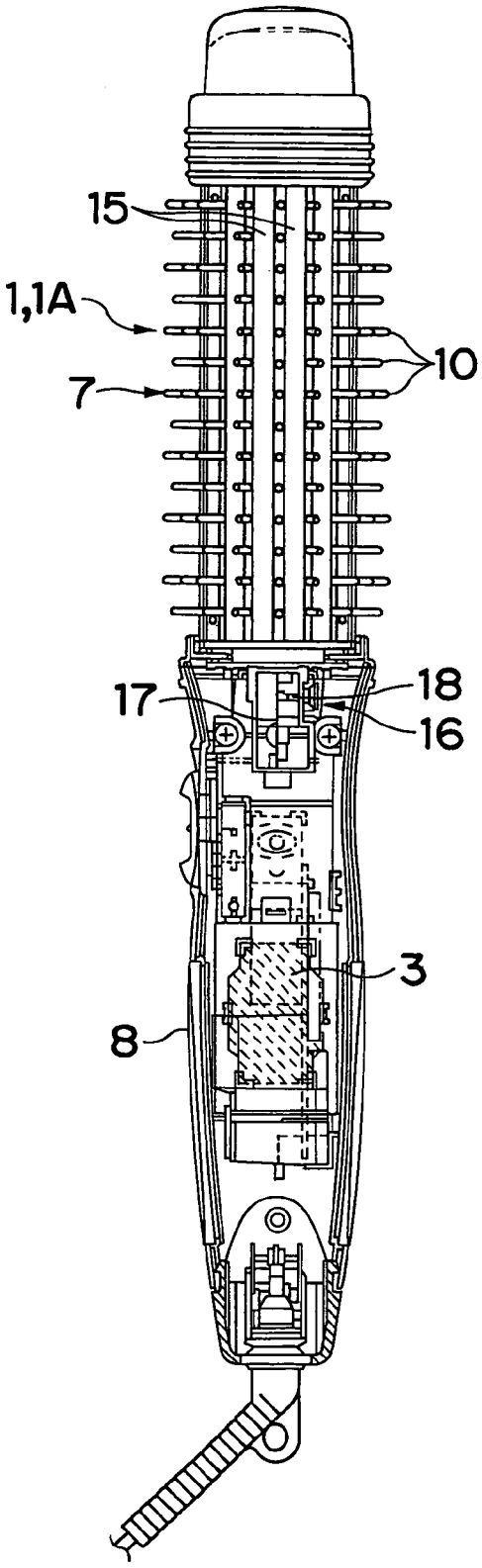
FIG. 18A is a front sectional view of a hair iron having an ion generator.
Figure 18B:
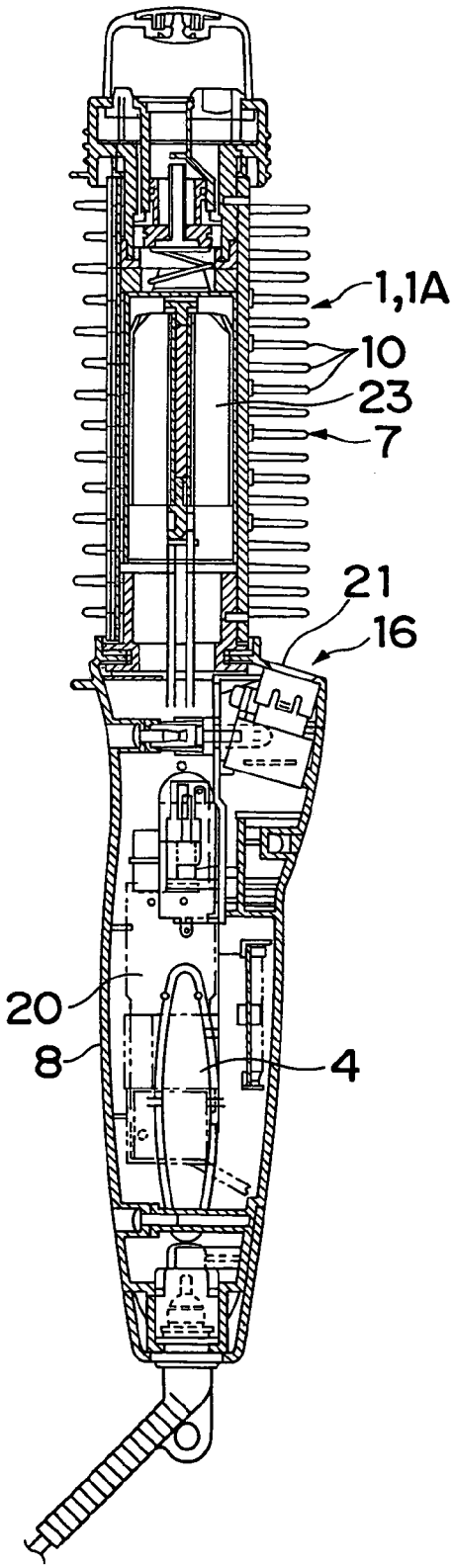
FIG. 18B is a side sectional view of the hair iron.

FIGS. 17A and 17B are a side view and a front view of a hair brush 1D having an ion generator 16. FIGS. 18A and 18B are a sectional front view and a sectional side view of the hair brush 1D. The ion generator 16 of the hair brush 1D has a function to emit negative ions. Except the ion generator 16, the hair brush 1D has a structure wherein the hair brush 1A (FIGS. 1A and 1B) is combined with the hair brush 1C (FIGS. 16A and 16B) having the brush part 7 with the heating plate 15. The brush 5 has the heater 23 (FIG. 18B) for heating the heating plate 15. The heater 23 is similar to the heater explained with reference to FIG. 16A. The other structure of the brush part 7 is substantially similar to the hair brush 1A (FIGS. 1A and 1B), and the explanation thereof is omitted here.

Figure 19:
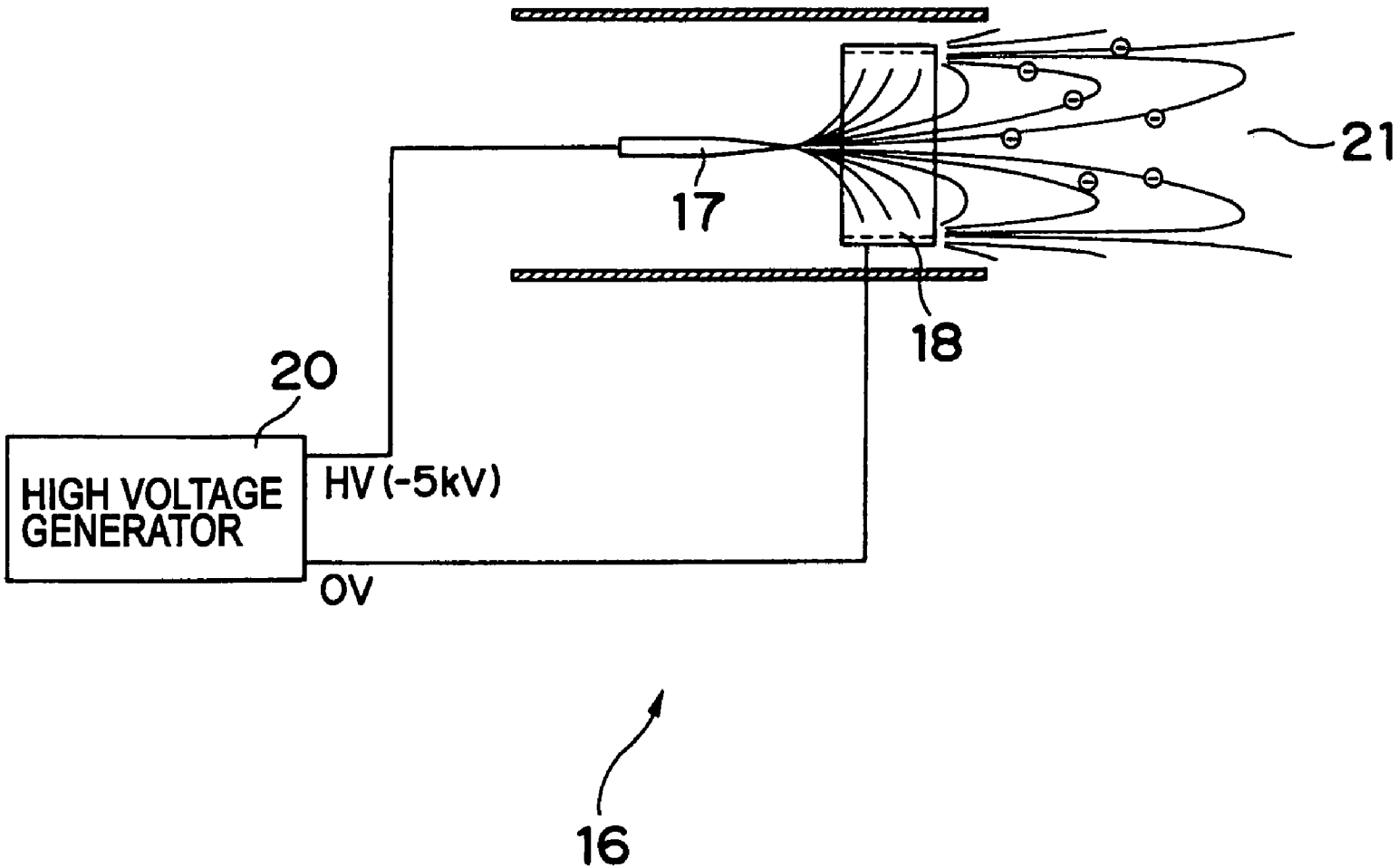
FIG. 19 is a circuit diagram for explaining the ion generator.

FIG. 19 shows a structure of the ion generator 6. The ion generator 16 generates negative ions due to corona discharge. Negative ions represent particles wherein negatively charged oxygen are combined with very small water in air. The size of negative ion is for example a few nanometers in diameter.

The ion generator 16 is included in the mechanism for setting hair in the hair brush 1D, and it has a needle-like discharge electrode 17, a ground electrode 18 and a high voltage generator 20. The needle-like discharge electrode 17 has a metallic bar having a sharp tip like a needle. The ground electrode 18 is a metallic plate arranged in the front oblique direction relative to the needle-like discharge electrode 17. The high voltage generator 20 has a standard voltage terminal and a high voltage terminal. The standard voltage terminal is connected to the ground electrode 18, and the high voltage terminal is connected to the needle-like discharge electrode 17.

If the high voltage generator 20 applies DC −5 kV to the needle-like discharge electrode 17, corona discharge occurs around the sharp tip of the electrode. 17 because the electric field is concentrated due to the sharp tip. At the same time, negative ions are generated. The generated negative ions are blown through the outlets 21 provided along an extension line from the discharge electrode 17 to the ground electrode 18. As shown in FIG. 19, negative ions are moved along the electrostatic force lines towards the human body and attracted and adhered to the hair 5*a* (FIG. 6).

By using the hair brush 1D (FIGS. 17A, 17B, 18A and 18B), negative ions are generated by the ion generator 16 on brushing, and the negative ions are adhered to the positively charged hair 5*a*. The negative ions can make the hair moist or smooth. Further, by applying the positive voltage to the human body continuously by operating the electrostatic charger section 2, the negative ions from the ion generator 16 are not neutralized and are kept to be attracted and absorbed to the hair 4*a*. Then the advantage of making the hair moist or smooth is enhanced further. The hair brush 1D also has the advantage of the hair brush 1A.

Figure 20:
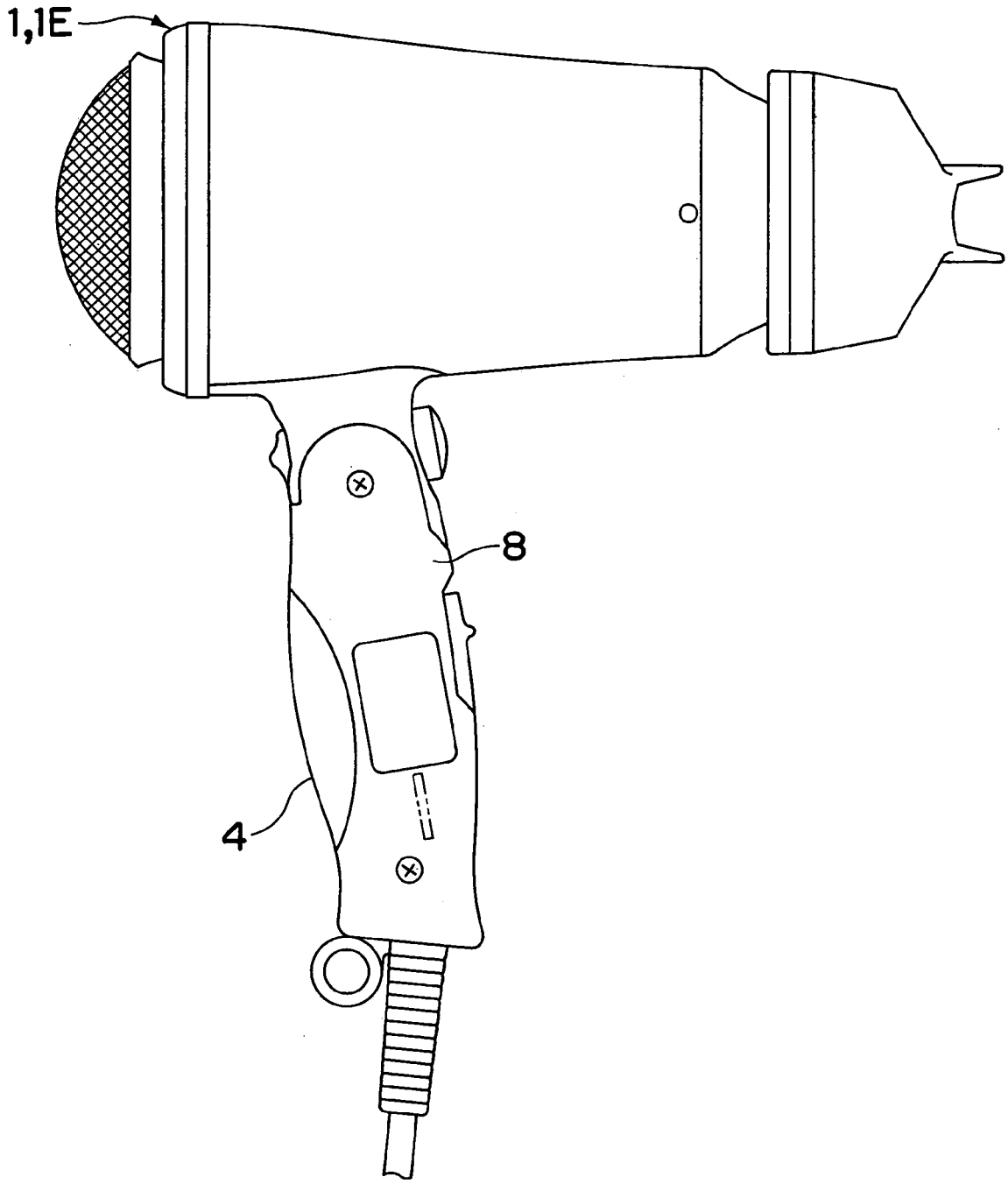
FIG. 20 is a sectional view of a hair drier according to the invention.
Figure 21:
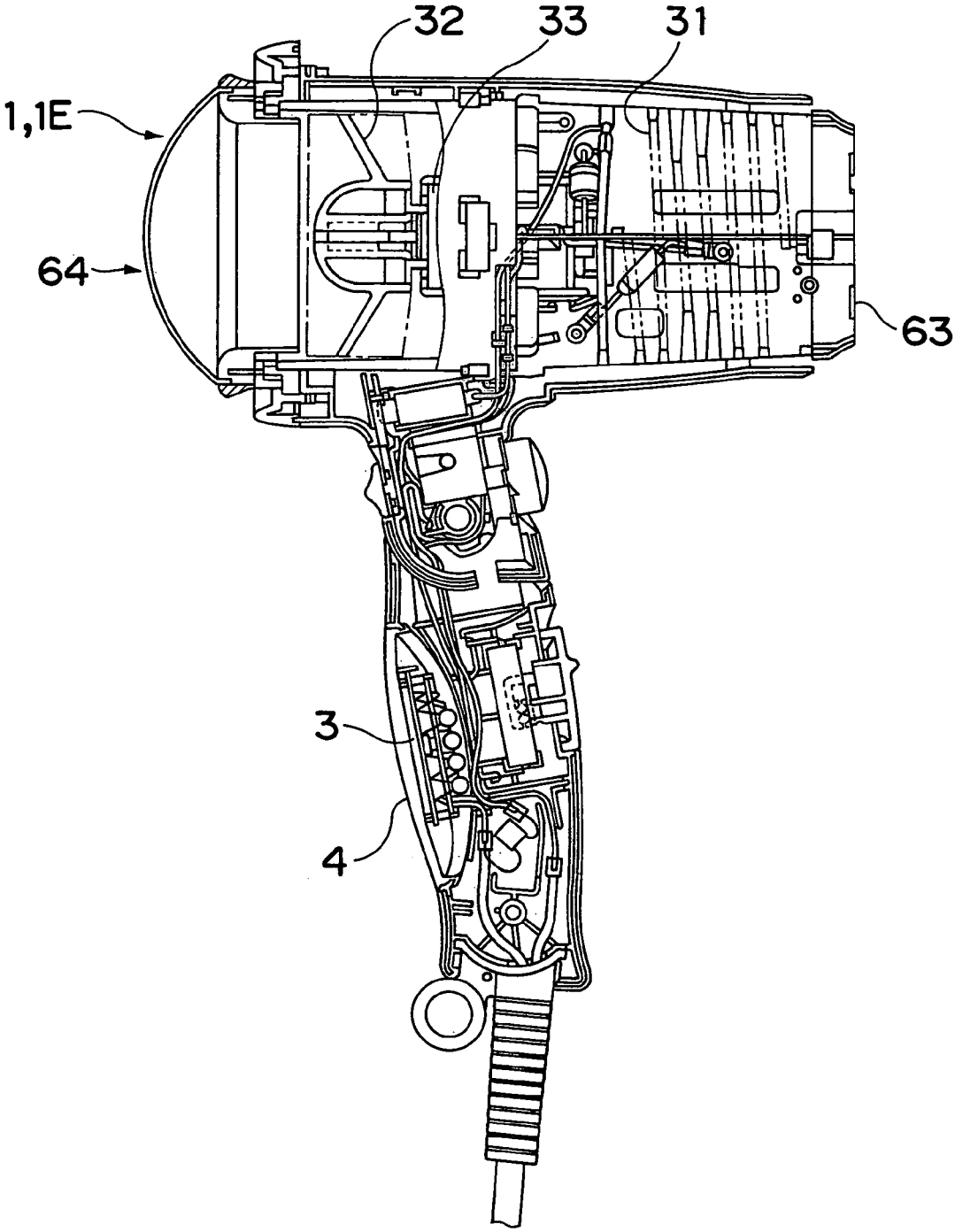
FIG. 21 is a sectional view of the hair drier according to the invention.
Figure 22A:
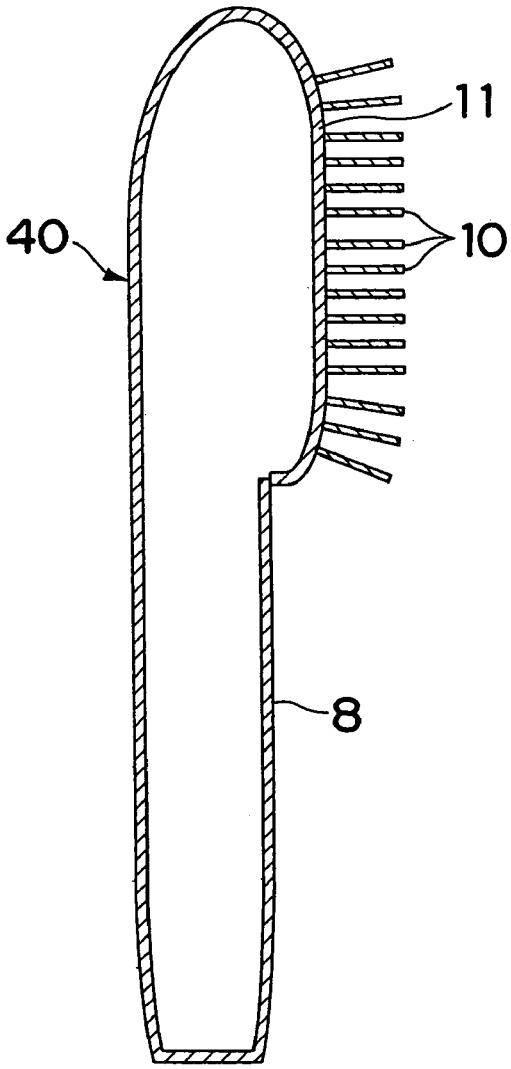
FIG. 22A is a side sectional view of a prior art hair brush.
Figure 22B:
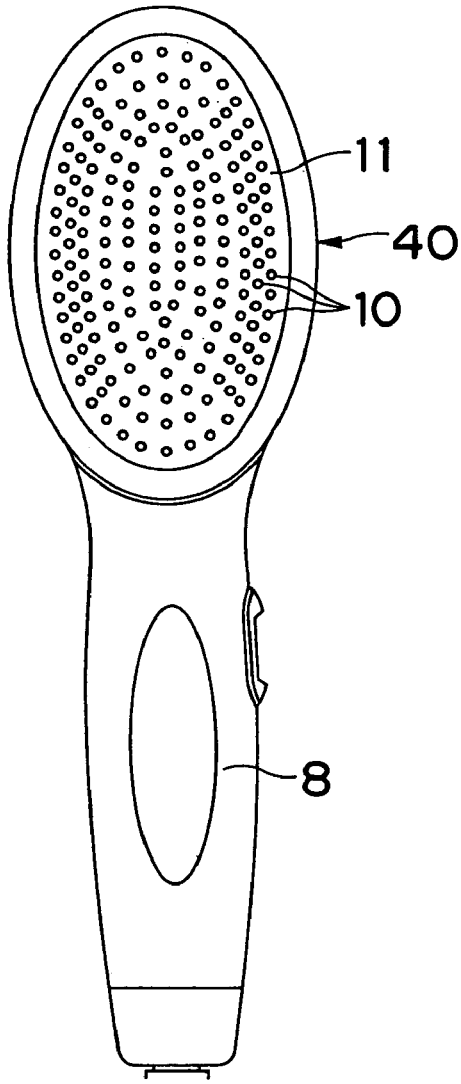
FIG. 22B is a front view of the hair brush.

FIG. 20 is a sectional side view of a hair drier 1E according to the invention, and FIG. 21 is a sectional view of a structure of the hair iron 1E. The hair drier 1E shown in FIGS. 20 and 21 is different from the hair brush B (shown in FIGS. 15A and 15B) only in that the hair drier 1E does not have the brush part 7. For example, the hair drier 1E has the charging circuit 3 and the charging plate 4 in common to the hair brushes 1B and 1A (FIGS. 1A and 1B). Then, the explanation on the structure of the hair drier 1E is omitted here. The mechanism for setting the hair in the hair drier 1E is a drying mechanism for hair.

The procedures and techniques for drying hair by the hair drier 1E are similar to a known hair drier. However, the hair drier 1E can charge the hair with electrostatic charges of the same or opposite polarity to the charges in the hair, and this is more advantageous than a known hair drier. The reasons are explained below. When the hair 5*a* is set only by the drier (FIG. 6) or is brushed by both the hair brush and the drier, repetitive contact with the hair occurs, and the hair is dried gradually. As a result, the electrostatic charges are liable to be generated in the hair 5*a* (FIG. 6). Especially when the hair brush is used, a difference in triboelectric series is present between the material of the hair brush and the hair, the generation of charges becomes obvious. Then by using the charging circuit 3 and the charging plate 4 (FIG. 21), for example charges of the opposite polarity to that of the generated charges are supplied to the human body 5 for discharging, the hair can be set easily.

In the embodiments according to the invention explained above, human hair is the object to be dealt with. However, the invention can also be effective when hair or fur of an animal such as a dog or a cat is trimmed or when woolen goods such as a carpet is put in order. However, because an animal or the like cannot grip the charging plate 4 (for example FIG. 1A), a charging code or the like may be provided to give the same voltage as the charging plate, and it may be contacted with an object to be applied or a neighborhood thereof. Then, the above-mentioned advantage can be obtained.

The invention claimed is:

1. A hair setting instrument comprising:

a hair setting mechanism that sets hair of a user, said hair setting mechanism including a grip;

an electrostatic charger, located within the grip, which supplies charges to a body of a user for electrostatic charger generated by a movement for setting hair;

wherein the electrostatic charger comprises:

a charging circuit which receives a commercial power supply and generates a negative predetermined voltage relative to the ground;

and a charging plate electronically connected to the charging circuit, wherein when the charging plate is contacted by a user, the charging plate supplies charges to the user's body according to the predetermined voltage outputted by the charging circuit.

2. The hair selling instrument according to claim 1, wherein the charging plate is provided on a surface of the grip.

3. The hair setting instrument according to claim 1, wherein said charging plate is made of an electrically conducting material.

4. The hair setting instrument according to claim 1, further comprising an electrically conducting sheet on a surface of the charging plate to which a user makes contact with the charging plate.

5. The hair setting instrument according to claim 1, wherein said mechanism for setting user's hair comprises a brush and a mechanism which dries the hair.

6. The hair setting instrument according to claim 1, wherein said mechanism for setting user's hair comprises a pair of heating plates for gripping the hair and a heater which heats the heating plates.

* * * * *

UNITED STATES PATENT AND TRADEMARK OFFICE

CERTIFICATE OF CORRECTION

PATENT NO. : 7,171,970 B2
APPLICATION NO. : 10/500471
DATED : February 6, 2007
INVENTOR(S) : I. Saida et al.

It is certified that error appears in the above-identified patent and that said Letters Patent is hereby corrected as shown below:

At column 10, line 11 (claim 2, line 1) of the printed patent, “selling” should be --setting--.

Signed and Sealed this

Twenty-seventh Day of May, 2008

JON W. DUDAS
*Director of the United States Patent and Trademark Office*